United States Patent [19]

Kamiya et al.

[11] Patent Number: 4,512,229

[45] Date of Patent: Apr. 23, 1985

[54] SCORING SYSTEM

[75] Inventors: Kenji Kamiya; Masatoshi Hosoi, both of Ena, Japan

[73] Assignee: Ricoh Watch Co., Ltd., Gifu, Japan

[21] Appl. No.: 631,571

[22] Filed: Jul. 17, 1984

Related U.S. Application Data

[63] Continuation of Ser. No. 377,225, May 11, 1982, abandoned.

[30] Foreign Application Priority Data

May 18, 1981 [JP] Japan ..... 56-74758

[51] Int. Cl.[3] ..... G10H 7/00

[52] U.S. Cl. ..... 84/1.01; 84/1.03

[58] Field of Search ..... 84/1.01, 1.02, 1.03, 84/1.28, 115, 462, 483 R, 483 A, DIG. 12, DIG. 29, DIG. 11

[56] References Cited

U.S. PATENT DOCUMENTS

| | | | |
|---|---|---|---|
| 4,022,097 | 5/1977 | Strangio | 84/1.03 |
| 4,202,235 | 5/1980 | Namiki et al. | 84/1.01 |
| 4,273,019 | 6/1981 | Goto | 84/DIG. 11 |
| 4,357,849 | 11/1982 | Ezawa et al. | 84/1.01 |
| 4,378,720 | 4/1983 | Nakada et al. | 84/1.03 |
| 4,417,494 | 11/1983 | Nakada et al. | 84/1.03 |
| 4,448,104 | 5/1984 | Hoshii | 84/1.01 |
| 4,454,796 | 6/1984 | Inoue et al. | 84/1.03 |

*Primary Examiner*—S. J. Witkowski

[57] ABSTRACT

A musical scoring system for scoring music arranged in measures. The system preferably includes a keyboard unit having a plurality of keys, a clock generator, a counter for counting clock signals generated by the clock generator and a summing circuit for maintaining a running sum of a series of quantized note, rest length values during each measure of the music to be scored. When keys are operated at the keyboard unit, a subtracting and converting means subtracts the value then stored in the register from the value stored in the counter and quantizes the result to produce a new quantized note/rest length value. This new quantized note/rest length value is thereafter summed by the summing means to the value stored in the register. Preferably, at the beginning of each measure of the music to be stored, the contents of the counter and the register are cleared and the summing means, and subtracting and converting means are provided by a central processing unit.

8 Claims, 4 Drawing Figures

SCORING SYSTEM

This is a continuation of co-pending application Ser. No. 377,225 filed May 11, 1982 and now abandoned.

BACKGROUND OF THE INVENTION

The invention relates to a musical scoring system capable of producing a musical score by processing note/rest length data and interval data obtained in response to playing a keyboard, and in particular, to a system which accurately quantitizes the length of notes and rests based on such data.

A conventional quantization technique used in scoring systems comprises deriving a quantized value of note or rest from the difference ($D_n - D_{n-1} \rightarrow S_n$) between a current note/rest length data ($D_n$) and an immediately preceding note/rest length data ($D_{n-1}$) obtained by operation of the keyboard. It will be observed that if timing of the human keyboardist is precise and in accordance with the note and rest values of the music, the resulting score will be correct regardless of the quantization technique employed. Hence, such a system will produce a musical sheet which correctly corresponds to the original from which the music was played in the beat and intervals of the notes and rests. However, playing the keyboard in a precise manner as called for by the original music is almost impossible to a typical player, and, in particular, for a beginner. Accordingly, when a melody played on the keyboard is quantized on a real time basis to form a musical score, a quantization error will result. In particular, when the conventional difference technique mentioned above is employed, the quantization error accumulates gradually toward the end of a measure, resulting in an appreciable deviation in the timing between musical score produced by the actual operation of the keyboard and the timing and meter of the original music being scored. This also means that the alignment with the timing or meter is provided toward the end of the measure. Other difficulties of this technique are that the magnitude of the quantization error cannot be determined until the music being scored is actually played again, and that the editing of the resulting improperly timed musical score is typically very troublesome.

SUMMARY OF THE INVENTION

It is an object of the invention to eliminate above difficulties of the prior art, by providing a scoring system which suppresses a quantization error below a given value, minimizes as differential timing between the actual operation of the keyboard and the musical sheet being scored, and improves the alignment with the timing or meter.

DESCRIPTION OF EMBODIMENT

Figure 1:
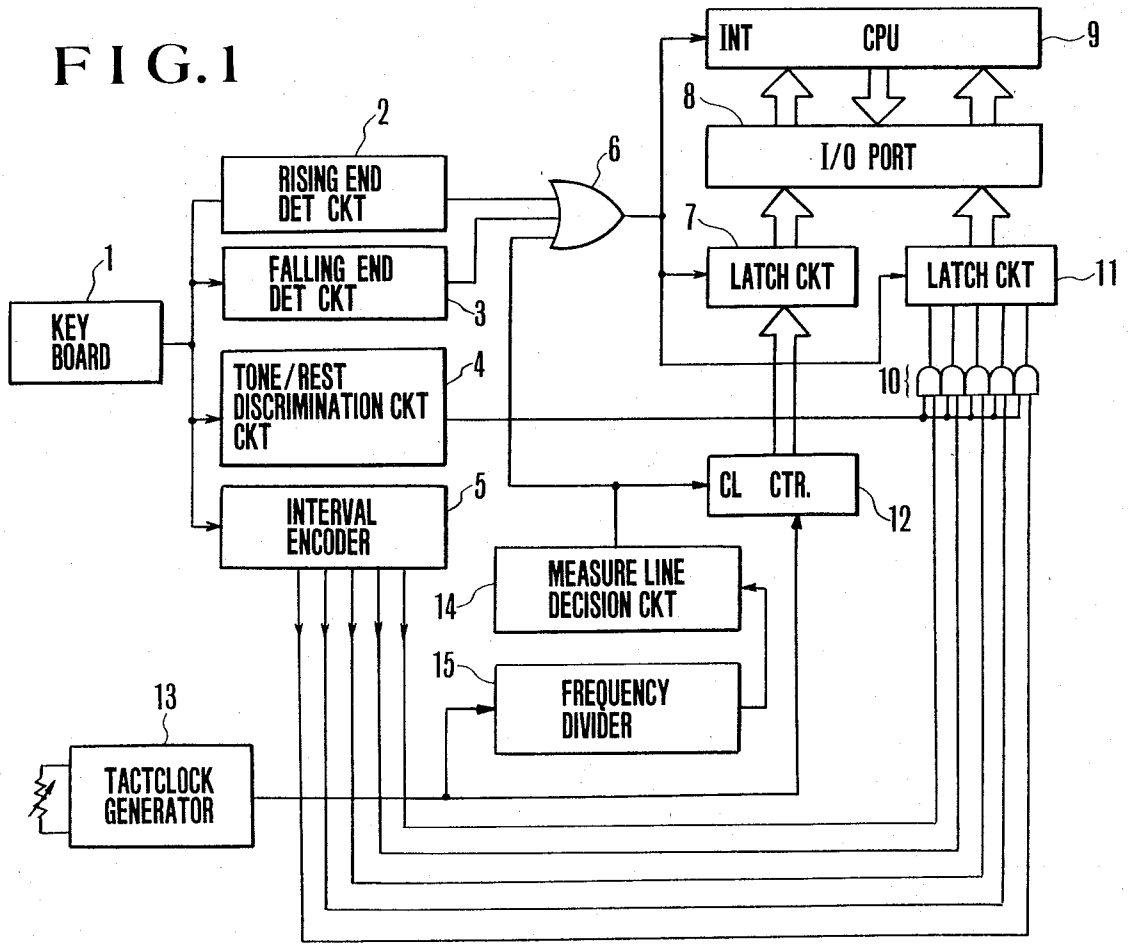
FIG. 1 is a block diagram of a scoring system according to one embodiment of the invention.

Referring to FIG. 1, there is shown a scoring system according to one embodiment of the invention. In this Figure, a keyboard unit 1 includes a number of keys which can be selectively depressed. Connected to the keyboard unit 1 is a rising edge detector circuit 2 which produces a key on signal PE (see FIG. 2) by detecting the depression of a key in a keyboard unit 1, a falling edge detector circuit 3 which produces a key off signal NE (FIG. 2) by detecting the release of the key, a note/rest discriminator circuit 4 which discriminates a note from a rest, and an interval encoder 5 for encoding an interval which corresponds to a particular key being depressed into a 5 bit data byte. The key on signal PE from the detector circuit 2 and the key off signal NE from the detector circuit 3 are fed to an OR gate 6. The output of OR gate 6 is supplied to a latch circuit 7 as a note/rest length data entry signal, and to a central processing unit (hereinafter abbreviated as CPU) as a data interrupt signal INT. The CPU is connected with the latch circuit 7 through an I/O port 8. The five bit interval data byte from the encoder 5 is fed to five AND gates 10, each of which also receive an input from the note/rest discriminator circuit 4. The outputs from the gates 10 are supplied to another latch circuit 11, the latching operation of which is also controlled by the output from the OR gate 6. The interval data is fed from the latch circuit 11 to CPU 9, through the I/O port 8 to be processed therein together with the tone/rest length data fed from the latch circuit 7 to form musical sheet data, which is output to a display or memory, not shown.

The note/rest length data to be stored in the latch circuit 7 is supplied from a counter 12, which is in turn clocked by a clock signal CK produced by a clock generator 13. A sequential count in the counter 12 is latched as note/rest length data for subsequent entry into the CPU 9 each time the key on signal PE and the key off signal NE are supplied to the latch circuit 7 from the respective circuits 2, 3 through the OR gate 6. Specifically, a differential count in the counter 12 produced from the time the key on signal PE is supplied to the latch circuit 7 until the key off signal NE is supplied thereto (in other words, during an interval corresponding to the duration of depression of a key) is supplied to the latch circuit 7 as note length data while a differential count in the counter 12 which is produced from the time the key off signal NE is supplied to the latch circuit 7 until the next key on signal PE is supplied thereto as a result of a following key depression (in other words, for a time interval during which no key is depressed) is supplied to the latch circuit 7 as rest length data.

A measure line decision circuit 14 produces a single pulse for each measure, for example, four beats of quarter notes for common time (4/4), and the measure line signal is applied to the counter 12 as a clear signal, thus clearing it after it has reached a given count corresponding to one measure, for example 256. The measure line signal from the decision circuit 14 is also fed through OR gate 6 to serve as a latching signal acting upon the latch circuits 7, 11, and is also input to the CPU 9 as an interrupt signal. A frequency divider 15 is connected to the output of the clock generator 13, and supplies a signal to the decision circuit 14 which represents a frequency division of the clock frequency. By way of example, the frequency divider 15 divides the frequency of the clock signal in a manner such that it produces a single pulse in response to each quarter note. Accordingly, in this example, the decision circuit 14 outputs a measure line signal after it has counted four pulses.

Figure 2:
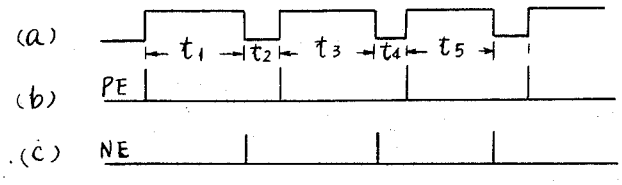
FIG. 2 shows a series of timing charts which illustrate the operation of a rising and a falling end detector circuit used in the invention.

In operation, a player may operate the keyboard 1 in a manner to produce a key input of a pattern as illustrated graphically in FIG. 2 at (a). The rising edge detector circuit 2 produces the key on signal PE, illustrated at (b), in response to the depression of a particular key. Similarly, the falling edge detector circuit 3 outputs the key off signal NE, illustrated at (c), in response to the release of the particular key being depressed.

When the system is initialized, a clock signal from the clock generator 13 is supplied to the counter 12, which then counts up the clock signal. Simultaneously, the clock signal is divided by the frequency divider 15, and the pulse therefrom are counted by the decision circuit 14, which delivers a measure line signal defining the boundary between adjacent measures. The measure line signal delivered clears the counter 12, and is also supplied as an interrupt signal to CPU 9 through OR gate 6, together with the key on signal PE and the key off signal NE. Each time the key on signal PE and the key off signal NE are supplied to the latch circuit 7, a differential count in the counter 12 is entered into the latch circuit 7 as the note/rest length data, which is subsequently transferred to CPU 9 in response to an interrupt instruction.

Figure 3:
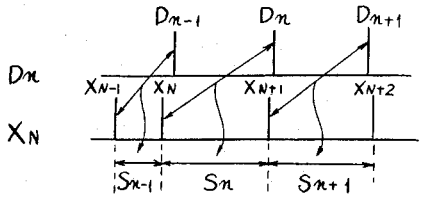
FIG. 3 is a diagrammatic illustration of a quantization according to $D_n$-$X_n$ technique of the invention.

In this manner, the CPU 9 receives the aforementioned data in order to quantize the intervals of the notes and rests. The actual note/rest length data is represented by $D_n$ which is supplied to the latch circuit 7 during an n-th measure, while a sum of quantized values for the notes $S_n$ from the beginning of the measure is represented by $X_n$. The CPU 9 operates to perform a quantization process of $D_n - X_n \rightarrow S_N$. Consequently, the quantized value of the note/rest corresponding to n-th data $D_n$ is equal to $X_{n+1} \leftarrow X_n + S_n$. This is diagrammatically illustrated in FIG. 3.

Figure 4:
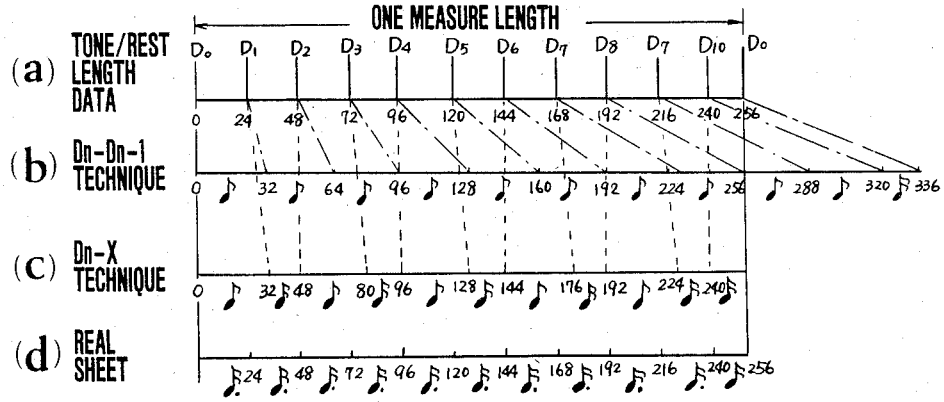
FIG. 4 is a diagrammatic illustration of the technique according to the invention as compared with the conventional technique.

FIG. 4 shows an example of the quantization technique $(D_n - X_n)$ according to the invention and the conventional difference technique $(D_n - D_{n-1})$ for common (4/4) time with a single measure of 256 counts.

Specifically, it may be assumed that note/rest length data $D_0, D_1, D_2, \ldots$ are supplied to the CPU 9 at timings as indicated in FIG. 4 at (a). However, the original music which conforms to this timing actually corresponds to the ten dotted sixteenth notes ♪ and one undotted sixteenth note indicated at (d). In practice, however, a quantization is performed utilizing an eighth note ♪ and a sixteenth note ♪. Thus, the count for the eighth note ♪ ranges from 24 to 39, and has a quantized value of 32. The count for the sixteenth note ♪ ranges from 8 to 23, and has a quantized value of 16. It is to be assumed that the dotted sixteenth note ♪ has not been quantized for this example.

Accordingly, if the conventional difference technique $(D_n - D_{n-1})$ is utilized to perform the quantization for the data shown at (a) in FIG. 4, the result of quantization will be as shown at (b). Thus, the ten dotted sixteenth notes are all transformed to eighth notes, resulting in a single measure which contains five and $\frac{1}{4}$ beats, deviating from the common (4/4) time. Of course, this does not fairly represent the meter of the original music. In addition, an offset in the timing between the actual key depression and the description of the musical sheet increases toward the end of the measure.

By contrast, according to the technique $(D_n - X_n)$ of the invention, the tones will be arranged as indicated in FIG. 4 at (c) as a result of the quantization. The single measure contains four beats, maintaining the proper meter even though the system was assumed not to be capable of recognizing dotted sixteenth notes. In addition, the timing appearing on the musical score is maintained substantially coincident with the timing of the actual depression throughout the measure. This means that the quantization error is minimized while operating a musical score with proper meter.

When the interval data is added to the quantized data within the CPU 9, there is obtained a musical score which corresponds to the musical tones produced by the operation of the keyboard 1. The musical score may be graphically shown on a display and/or saved in a memory using conventional technology.

As discussed above, in accordance with the invention, quantization of a note takes place by forming a difference $(D_n - X_n)$ between the note/rest length data $(D_n^{\cdot})$ which is sequentially supplied to the CPU in response to operation of the keyboard, and a quantized sum $(X_n)$ of the quantized notes and rests from the beginning of a particular measure. This minimizes the quantization error, and also reduces any misalignment in the timing between the actual key operation and the original musical score while maintaining good alignment with the meter.

What is claimed is:

1. A music scoring system for scoring music arranged in measures, said system comprising:

(a) a clock generator;

(b) a counter for counting clock signals generated by the clock generator;

(c) means for clearing the contents of the counter;

(d) means for summing a series of quantized note/rest length values during each measure of the music to be scored; and (e) means for subtracting the current sum generated by the summing means from the value stored in said counter and converting the result thereof to a new quantized note/rest length value.

2. The music scoring system according to claim 1 wherein said summing means, and said subtracting and converting means comprise a central processing unit.

3. The music scoring system according to claim 1 wherein said converting means converts said results using a predetermined look-up table to convert each result in certain ranges to predetermined singular values.

4. The music scoring system according to claim 1 further including a keyboard unit having a plurality of keys, rising and falling edge detector circuits coupled to said keys for detecting the actuation of the keys at the keyboard unit and means responsive to said rising and falling edge detector circuits for coupling the contents of said counter to said subtracting means.

5. The music scoring system according to claim 4 further including an interval encoder responsive to said keys to generate a code indicative of the particular key depressed and means responsive to said rising and falling edge detector circuits for providing said code as an output from said system together with said quantized note/rest length value.

6. The music scoring system according to claim 5 further including means for inhibiting the transmission of said code from said encoder to said output during rests.

7. The music scoring system according to claim 1 wherein said summing means includes a register for maintaining a running sum of the quantized note/rest length values and wherein said clearing means clears the contents of the counter and said register during each measure of the music to be scored.

8. The music scoring system according to claim 7, wherein each new quantized note/rest length value generated by the subtracting and converting means is subsequently added to the contents of said register by said summing means.

* * * * *